United States Patent [19]

Albery

[11] Patent Number: 4,630,731

[45] Date of Patent: Dec. 23, 1986

[54] BROCHURE HOLDER AND BLANK THEREFOR

[75] Inventor: Lewis L. Albery, Dolton, Ill.

[73] Assignee: The Cooperative Marketing Co., Elk Grove Village, Ill.

[21] Appl. No.: 699,815

[22] Filed: Feb. 8, 1985

[51] Int. Cl.[4] ..... B65D 37/00

[52] U.S. Cl. ..... 206/425; D19/78; 206/555; 211/50; 229/8

[58] Field of Search ..... D19/75, 78, 86–88; 206/45.31, 232, 233, 449, 425, 554, 555; 211/50, 55, 69.1; 221/33; 229/2.5, 17 S

[56] References Cited

U.S. PATENT DOCUMENTS

| | | | |
|---|---|---|---|
| 213,681 | 3/1879 | Norris | 211/55 |
| 2,638,211 | 5/1953 | Spurr | 206/449 |
| 2,975,905 | 3/1961 | Foland | 211/50 |
| 3,392,903 | 7/1968 | Morgan, Jr. | 211/50 |
| 3,493,104 | 2/1970 | Tempelhof | 206/45.31 |
| 3,695,514 | 10/1972 | Mascetti, Jr. | 229/2.5 |
| 3,903,789 | 9/1975 | Hurley | 211/50 |
| 3,937,389 | 2/1976 | Wind | 229/2.5 |
| 4,373,636 | 2/1983 | Hoffman | 229/2.5 |
| 4,424,906 | 1/1984 | Richmond | 211/50 |
| 4,482,052 | 11/1984 | Wischusen | 206/409 |

FOREIGN PATENT DOCUMENTS

| | | | |
|---|---|---|---|
| 0248379 | 4/1947 | Switzerland | 206/425 |

*Primary Examiner*—William Price
*Assistant Examiner*—Jimmy G. Foster
*Attorney, Agent, or Firm*—Fitch, Even, Tabin & Flannery

[57] ABSTRACT

A preformed plastic blank and a brochure holder assembled therefrom. The holder includes a front panel with an adjoining bottom panel and two adjoining side panels. Adjoining each side panel is a back panel. Each panel has a raised center portion to provide for enhanced torsional rigidity, and the adjoining panels have perforations at their common edges. To facilitate access to the brochures, the bottom panel has an inclined surface formed therein sloping downward from the rear of the holder toward the front to urge any brochures held therein towards the front of the holder. The assembled blank is held together by complementary projecting hollow fingers and cavities formed on the marginal portions of the back panels and on a flap pending from the bottom panel.

12 Claims, 8 Drawing Figures

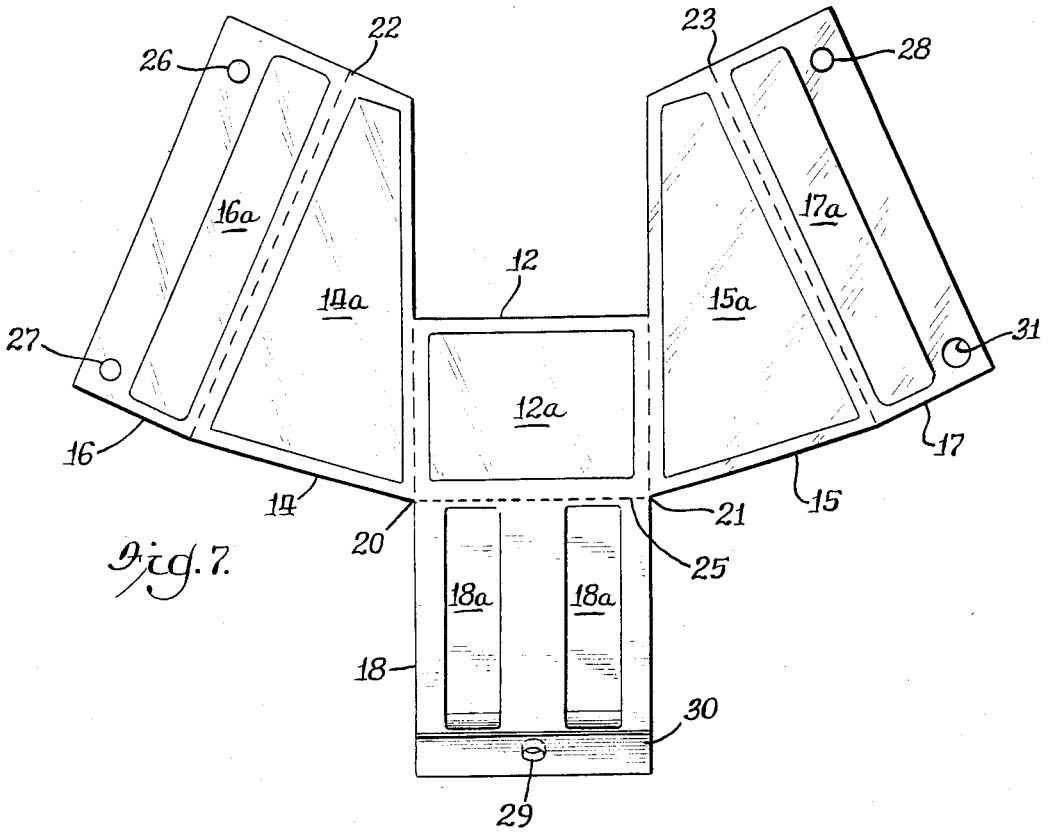
Fig. 7.
Fig. 8.
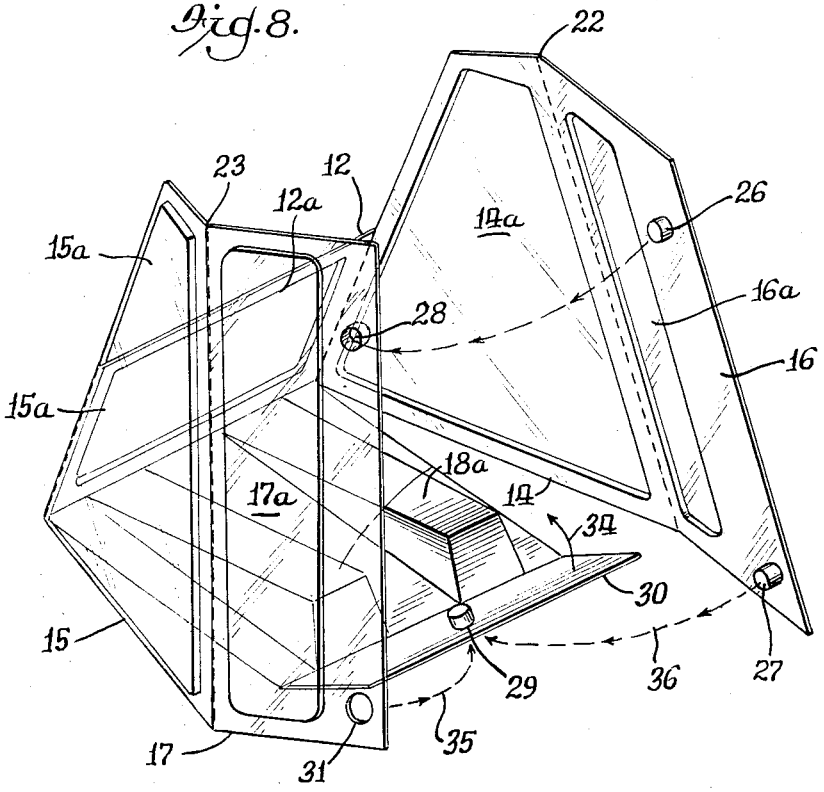

BROCHURE HOLDER AND BLANK THEREFOR

BACKGROUND OF THE INVENTION

This invention relates to a holder for brochures and the like and, more particularly, to a preformed plastic blank and the holder assembled therefrom.

A popular way of advertising one's goods or services is to provide potentially interested persons with brochures, fliers, etc., describing the goods or services. In particular, companies providing travel-related services have found a relatively captive and potentially interested market standing in lines that form at airline gates, car rental counters, hotel desks, and the like and, consequently, make available to these persons brochures relating to such things as credit card services, airline schedules, automobile rental rates, etc.

SUMMARY OF THE INVENTION

Accordingly, it is an object of the present invention to provide a holder for brochures suitable for placement on a countertop or the like which displays such brochures to their best advantage and facilitates access to the brochures.

It is an additional object to provide such a holder that is simple to manufacture in large quantities, at low cost, and that can be packaged compactly for shipping.

A still further object is to provide such a holder that is simply assembled without the need for special skills, tools, or adhesives.

Other objects and advantages of the invention will become apparent upon reading the following detailed description and upon reference to the drawings.

BRIEF DESCRIPTION OF THE DRAWINGS

FIG. 7 is a plan view of a vacuum-formed blank for making the inventive holder; and FIG. 8 is a perspective view showing the assembly of the blank of FIG. 8 into the holder of FIGS. 1–6.

DETAILED DESCRIPTION OF PREFERRED EMBODIMENT

Figure 1:
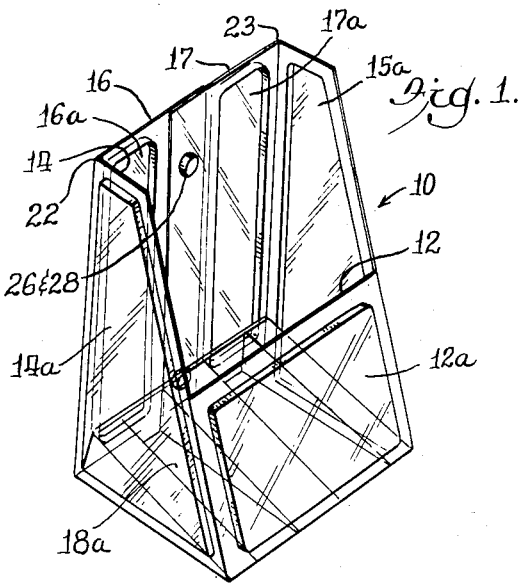
FIG. 1 is a perspective view of an assembled brochure holder in accordance with the invention.

Turning to the figures of the drawing, there is seen in FIG. 1 an assembled brochure holder, indicated generally by 10, made from a plastic, vacuum-formed blank as shown in FIG. 7. In practice, the holder is made of a clear plastic so as to allow one to see any printing or graphic design that is on the brochures to be contained therein. However, the holder could be made of opaque plastic and carry printing or other advertising on the exterior thereof. As best seen in FIGS. 1 and 7, the assembled holder 10 and vacuum-formed blank therefor include a front panel 12, side panels 14,15, overlapping back panels 16,17, and bottom panel 18. When the panels are arranged as shown in FIG. 7, with the blank being symmetrical about a vertical center-line through the front panel 12 and bottom panel 18, the maximum number of blanks can be die cut from a given sheet of plastic and the vacuum-formed blanks can be compactly packed and shipped flat in conventionally shaped containers.

Figure 2:
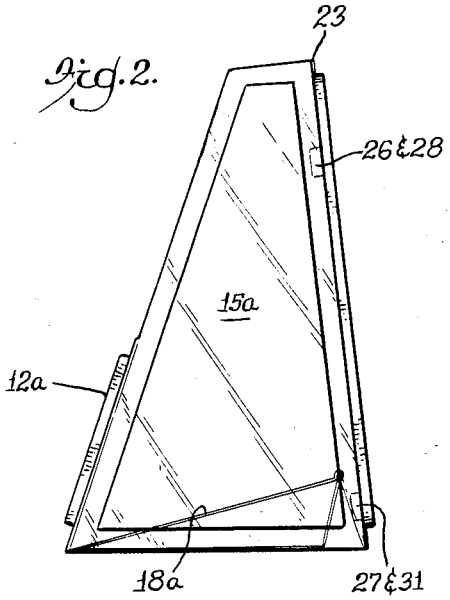
FIGS. 2, 3, 4, 5, and 6 are side, front, back, top, and bottom views, respectively, of the assembled brochure holder of FIG. 1.
Figure 3:
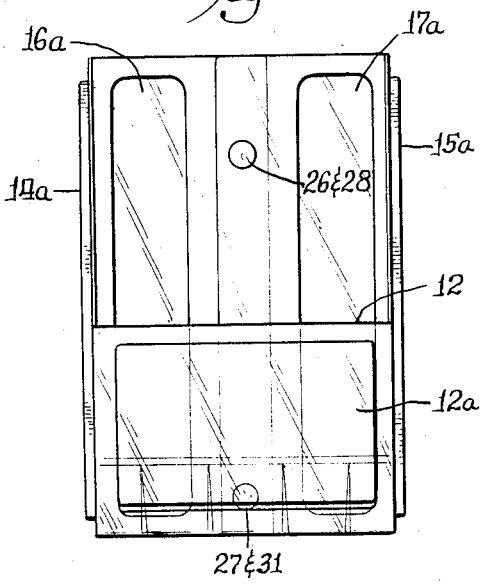
Figure 4:
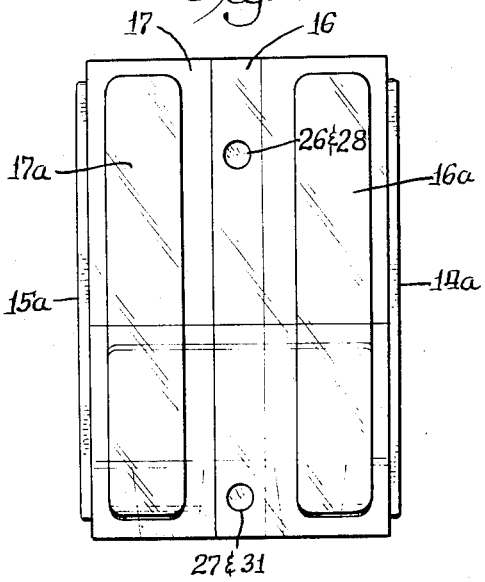
Figure 5:
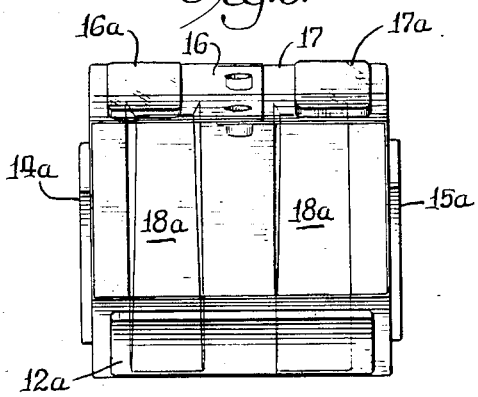
Figure 6:
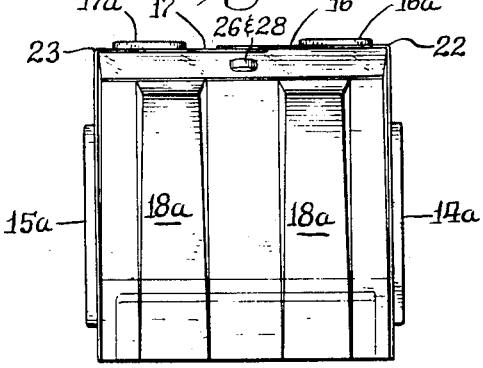

In keeping with one aspect of the invention, the bottom panel 18 is inclined to slope downward from the rear of the assembled holder toward the front of the holder, thus urging any brochures contained therein toward the front to best display the brochures. As best seen in FIGS. 2 and 7, the bottom panel is vacuum-formed to include inclined surfaces 18*a*. Best results have been obtained when the inclined surfaces 18*a* form approximately a 15 degree angle with respect to the horizontal.

Additionally, the vertical dimension of the front panel 12 is substantially less than the vertical dimension of its adjoining side panels 14, 15. As best seen in FIGS. 1–3 and 7–8, the front panel 12 is less than half the height of its adjoining side panels 14, 15 along its common edges 20, 21, respectively. As a result, brochures will protrude out of the holder in the area above the front panel 12 forward of the edges 20,21, to provide a ready corner of the brochure that can be grasped by an interested person. To further urge brochures toward the front of the holder, the back panels 16, 17 of the assembled holder also tilt forward. Referring in particular to FIGS. 2 and 7, the side panels 14, 15 are formed so that their rearward edges 22, 23 are at approximately an 83 degree angle from the horizontal.

To add to the rigidity of the holder, each of the panels is formed with a raised portion so that the panels resist torsional deformation. While the bottom panel 18 includes the inclined raised surfaces 18*a*, the front panel 12, side 14 panel, 15, and back panels 16, 17 also include raised panels 12*a*, 14*a*, 15*a*, 16*a* and 17*a*, respectively.

To facilitate the folding of the flat blank into the assembled holder, the common edges 21–25 of the various adjoining panels are perforated in the well-known manner when the flat blank is die-cut prior to being vacuum-formed. Once the blank is folded along its perforations to assume its assembled condition, the back panels 16, 17 and bottom panel 18 are secured together to maintain the relative positions of the panels. To this end, the back and bottom panels have integral interfitting fingers and cavities vacuum-formed therein. Turning to FIGS. 7 and 8, a marginal portion of back panel 16 includes two hollow, projecting circular fingers 26, 27 formed therein in spaced, vertical relation. Complementary oversized hollow cavities 28, 29 are vacuum-formed on, respectively, the overlapping marginal portion of back panel 17 and the depending flap 30 on the bottom panel 18. The fingers 26, 27 are sized so that they snugly fit within the cavities 28, 29, respectively. The back panel 17 also includes an aperture 31 sized to overfit finger 27 and lie in between the panel 16 carrying the interconnecting finger 27 and the panel 18 in which the cavity 29 is formed.

Referring to FIG. 8, to assemble the vacuum-formed blank into a brochure holder, initially, the side panels 14, 15 and the bottom panel 18 are folded with respect to the front panel 12 along perforations 20, 21 and 25. Secondly, the depending flap 30 on the bottom panel 18 is folded as indicated by arrow 34. Thirdly, the back panel 17 is folded with respect to side panel 15 along perforation 23, as indicated by arrow 35, to bring the aperture 31 into alignment with the opening in the hollow cavity 29 on the bottom flap 30. Finally, the back panel 16 is folded with respect to the side panel 14 so that the aperture 31 overlies the finger 27 before the finger is inserted into cavity 29. Simultaneously, the finger 26 of back panel 16 is received in the complementary cavity 28 in panel 17. As previously noted, the friction fit between the interfitting complementary fingers and cavities maintains the holder in its assembled condition.

Thus, it can be seen that a brochure holder and a blank for making such a brochure holder have been provided which fully meet the above stated objects. While the invention has been described in terms of a preferred embodiment, it is not intended to limit the invention to the same, but to include all equivalents and modifications within the scope of the accompanying claims.

What is claimed is:

1. A substantially flat, preformed one-piece plastic blank for assembling into a holder for brochures and the like comprising, in combination, a substantially rectangular front panel;

a first side panel adjoining the front panel on one side thereof;

a second side panel adjoining the front panel on the other side thereof;

said side panels each having a rear edge oriented at an acute angle to a bottom edge, a first substantially rectangular back panel adjoining the rear edge of the first side panel;

a second substantially rectangular back panel adjoining the rear edge of the second side panel, the first and second back panels being inclined forwardly from bottom to top when the holder is assembled as a result of the orientation of the rear edges of said side panels;

a bottom panel adjoining said front panel, the bottom panel having a surface formed therein inclined upwardly from front to back so that, when the holder is assembled, any brochures held therein will slide toward the front of the holder and having a flap hinged to its rear edge; and integral interfitting and frictionally engaging means on said bottom panel flap and said back panels for securing together the holder in its assembled condition which permit said blank to be shipped in a substantially flat condition and assembled without the use of tools or adhesives.

2. The combination of claim 1 wherein the panels have raised center portions and the adjoining panels have perforations at their common edges.

3. The combination of claim 2 wherein the side panels are substantially triangular in shape and the vertical dimension of the front panel is less than the vertical dimension of the adjoining edge of the side panel so that access to brochures contained within the assembled holder is facilitated.

4. The combination of claim 1 wherein the securing means comprise at least two hollow, projecting fingers formed in spaced, vertical relation on a marginal portion of the first back panel;

a mating cavity formed on a marginal portion of the second back panel sized to fit over the upper finger on the first back panel, the second back panel having an aperture therein sized to fit over the lower finger on the first back panel; and the bottom panel having a flap depending therefrom, the flap having a cavity formed thereon sized to fit over the lower finger on the first back panel.

5. The combination of claim 1 wherein the inclined surface on the bottom panels forms approximately a 15° angle with respect to horizontal.

6. A plastic holder for brochures and the like comprising a front panel;

a first side panel adjoining said front panel on one side thereof;

a second side panel adjoining said front panel on the other side thereof;

said side panels each having a rear edge oriented at an acute angle to a bottom edge, a first back panel hinged to the rear edge of said first side panel;

a second back panel hinged to the rear edge of said second side panel, said back panels each having a width greater than half the width of said front panel so said second back panel overlaps a marginal portion of said first back panel, the first and second back panels being inclined forwardly from bottom to top as a result of the orientation of the rear edges of said side panels to said bottom edges thereof;

a bottom panel hinged either to a bottom edge of said front panel or to the bottom edge of one of said side panels, the hinged bottom panel extending transversely to said front, side and back panels and thereby providing a bottom for the holder, the bottom panel having an inclined surface formed therein inclined upwardly from front to back and a flap hinged to its rear edge, the inclined surface on the bottom panel and the inclined back panels ensuring that any brochures held within the holder will slide toward the front thereof; and integral means on said bottom panel flap and said back panels for securing together the holder.

7. The brochure holder of claim 6 wherein the panels have raised center portions and the adjoining panels have perforations at their common edges.

8. The brochure holder of claim 6 wherein said side panels are substantially triangular in shape and the vertical dimension of said front panel is less than the vertical dimension of the adjoining edge of each said side panel so that access to brochures contained within the holder is facilitated.

9. The brochure holder of claim 6 wherein said securing means comprise at least two hollow, projecting fingers formed in spaced, vertical relation on a marginal portion of said first back panel;

a mating cavity formed on a marginal portion of said second back panel sized to fit over the upper finger on said first back panel, said second back panel having an aperture therein sized to fit over the lower finger on said first back panel; and said bottom panel having a flap depending therefrom, the flap having a cavity formed thereon sized to fit over the lower finger on said first back panel.

10. The brochure holder of claim 6 wherein said inclined surface on said bottom panel forms approximately a 15° angle with respect to horizontal.

11. The brochure holder of claim 6 wherein the forwardly inclined back panels form approximately an 83° angle with respect to horizontal.

12. The brochure holder of claim 6 wherein said bottom panel is rectangular in shape and is hinged to the bottom edge of said front panel.

* * * * *

UNITED STATES PATENT AND TRADEMARK OFFICE

CERTIFICATE OF CORRECTION

PATENT NO. : 4,630,731

DATED : December 23, 1986

INVENTOR(S) : Lewis L. Albery

It is certified that error appears in the above-identified patent and that said Letters Patent is hereby corrected as shown below:

Claim 5. Column 4, line 2, change "panels" to --panel--.

Signed and Sealed this

Twenty-eighth Day of April, 1987

*Attest:*

DONALD J. QUIGG

*Attesting Officer*

*Commissioner of Patents and Trademarks*